US005690510A

United States Patent [19]

Chishima

[11] Patent Number: 5,690,510

[45] Date of Patent: Nov. 25, 1997

[54] FLAT CABLE CONNECTOR AND METHOD FOR ASSEMBLING FLAT CABLE AND A CONNECTOR HOUSING

[75] Inventor: Masamitsu Chishima, Yokkaichi, Japan

[73] Assignee: Sumitomo Wiring Systems, Inc., Mie, Japan

[21] Appl. No.: 758,447

[22] Filed: Nov. 29, 1996

Related U.S. Application Data

[63] Continuation of Ser. No. 390,786, Feb. 17, 1995, abandoned.

[30] Foreign Application Priority Data

Apr. 7, 1994 [JP] Japan ..... 6-095805

[51] Int. Cl.[6] ..... H01R 9/07

[52] U.S. Cl. ..... 439/496

[58] Field of Search ..... 439/83, 495, 496, 439/571, 885

[56] References Cited

U.S. PATENT DOCUMENTS

| | | | |
|---|---|---|---|
| 3,154,365 | 10/1964 | Crimmins | 439/496 |
| 4,188,086 | 2/1980 | Inouye et al. | 439/496 |
| 5,060,372 | 10/1991 | Capp et al. | 439/885 |
| 5,186,654 | 2/1993 | Enomoto et al. | 439/83 |
| 5,316,486 | 5/1994 | Tanaka et al. | 439/496 |
| 5,397,247 | 3/1995 | Aoki et al. | 439/496 |
| 5,401,186 | 3/1995 | Nozaki et al. | 439/495 |
| 5,474,468 | 12/1995 | Chishima et al. | 439/495 |

FOREIGN PATENT DOCUMENTS

| | | |
|---|---|---|
| 2 272 585 | 5/1994 | United Kingdom . |

*Primary Examiner*—Gary F. Paumen
*Attorney, Agent, or Firm*—Oliff & Berridge

[57] ABSTRACT

A flat cable connector housing includes a plurality of terminal receptacles into which terminals are to be inserted, and a cable insertion chamber communicated with the terminal receptacles. A forward end of a flat cable is connected and fixed to a lock member so that the flat cable is inserted together with the lock member into the cable insertion chamber. Accordingly, lock projections formed on the lock member engage with lock grooves in the connector housing so that the flat cable together with the lock member is prevented from slipping out of the connector housing.

10 Claims, 5 Drawing Sheets

FLAT CABLE CONNECTOR AND METHOD FOR ASSEMBLING FLAT CABLE AND A CONNECTOR HOUSING

This is a Continuation of application Ser. No. 08/390,786 filed Feb. 17, 1995 now abandoned.

BACKGROUND OF THE INVENTION

The present invention relates to a flat cable connector.

Heretofore, there is known a connector for connecting terminals to a flat cable in which electrical conductors are arranged side by side at predetermined intervals on an insulating sheet such as an FPC (flexible printed circuit), a ribbon cable, etc. An example of such a flat cable connector is shown in FIGS. 6, 7A and 7B.

In FIGS. 7A and 7B, a cable insertion chamber 42 is formed in a rear portion of a connector housing 40 so that a forward end of a flat cable 41 can be inserted into the cable insertion chamber 42, and a plurality of terminal insertion chambers 44 are formed separately in a front portion of the connector housing 40 so that terminals 43, which are fork-shaped, are inserted into the terminal insertion chambers 44 to be electrically connected to the flat cable 41. Further, a slide member 45 for fixing the flat cable 41 is included in the rear portion of the connector housing 40 so that the slide member 45 can be pushed into the connector housing 40. The slide member 45 has a pair of arm portions 46 at its left and right ends, only one of which is shown in FIG. 6. The arm portions 46 engage with opposite sides of the housing 40 at two positions thereof. One of the two positions is a temporary stop or lock position (where the flat cable 41 can be inserted) shown in FIGS. 6 and 7A and the other is a formal lock position (where the flat cable 41 is prevented from slipping off) shown in FIG. 7B. When the slide member 45 is in the temporary lock position, the flat cable 41 is inserted into the connector housing 40 and the rear portion of the slide member 45 is pushed so that the entire slide member 45 is forced into the housing 40. Thus, a pressing portion 47 of the slide member 45 enters the housing 40 and pushes down the flat cable 41 so that the flat cable 41 is forced into contact with the terminal 43. As a result, the flat cable 41 is kept in a state in which frictional force between the flat cable 41 and the terminal 43 prevents the flat cable 41 from slipping off.

The following problems, however, arise in the case of the aforementioned connector. Moreover, the conventional connector tends to be bulky and is not amenable to use in compact assemblies. One typical connector includes a width of about 15 mm and a thickness of about 2.5 mm. Furthermore, with respect to a portion into which the flat cable is inserted, the opening of the cable insertion chamber 42 is limited to be very narrow by the slide member. It is difficult to insert the extremely flexible flat cable 41 into such a narrow opening. Further, in the case of a lower contact type connector in which the flat cable 41 is made to pass through the lower side of the slide member 45 to thereby perform insertion as shown in FIGS. 7A and 7B, the slide member 45 becomes a barrier to the cable inserting work. Further, the connector of the type shown in FIGS. 7A and 7B is carried to the site of insertion/fixture of the flat cable 41 while the slide member 45 is kept in the temporary lock position. Accordingly, the slide member 45 may be pushed to the formal lock position by contact, or the like, with other connectors, when transporting the connector with the other connectors. When the slide member 45 is pushed to the formal lock position, it is necessary to return the slide member 45 to the temporary lock position again.

Further, because the retaining force of the flat cable 41 depends only on the press-fitting force between the slide member 45 and the terminals 43 caused by pushing the pressing portion 47 of the slide member 45, sufficient retaining force is difficult to obtain in a connector having only a few poles, so that there is a chance that the flat cable 41 will slip off.

Further, because the terminals 43 are inserted into the terminal insertion chambers 44 individually, the efficiency of the inserting operation is low.

SUMMARY OF THE INVENTION

The present invention is developed upon such circumstances and has an object to provide a flat cable connector in which the inserting operation for a flat cable and terminals can be carried out smoothly and easily.

To achieve the foregoing object, according to a first aspect of the present invention, a flat cable connector includes a cable insertion chamber formed in a rear portion of a connector housing so that a forward end of a flat cable is inserted into the cable insertion chamber; terminal receptacles formed in a front portion of the connector housing so that terminals are inserted into the terminal receptacles to communicate with the cable insertion chamber and to allow connection to the flat cable; a lock member fixed to the forward end of the flat cable in a state in which a surface of the lock member facing the terminals is exposed, the lock member being formed to be insertable into the cable insertion chamber; and a slip prevention device formed on the lock member, the slip prevention device bein positively and engageable with the connector housing. The connector housing and the lock member can be formed of different materials.

According to a second aspect of the present invention, a flat cable connector includes a cable insertion chamber formed in a rear portion of a connector housing so that a forward end of a flat cable is inserted into the cable insertion chamber; terminal receptacles formed in a front portion of the connector housing so that a plurality of terminals are inserted into the terminal receptacles to communicate with the cable insertion chamber and to allow connection to the flat cable; and respective base portions of the terminals are integrated with each other through a connection portion that is cut off at the time of attachment of the terminals to the connector housing.

According to a third aspect of the present invention, there is provided a connector having a housing having terminal insertion chambers and a cable insertion chamber that communicates with the terminal insertion chambers, the cable insertion chamber being adapted to receive a flat cable; a lock base for mounting the flat cable, the lock base and the flat cable being simultaneously insertable into the cable insertion chamber, the lock base being positively engaged with the housing upon insertion.

According to a fourth aspect of the present invention, there is provided a method for assembling a flat cable and a connector housing having terminal receiving chambers and a flat cable insertion chamber that communicates with the terminal insertion chambers. The method includes attaching a leading edge of the flat cable to a lock base, the lock base and the flat cable forming an insertion assembly; sliding the insertion assembly into the flat cable insertion chamber; and positively locking the insertion assembly within the housing.

According to a fifth aspect of the present invention, there is provided a method for assembling a flat cable into a connector housing having terminal receiving chambers and a flat cable insertion chamber that communicates with the terminal insertion chambers. The method includes providing a lock base that is separable from the connector housing; attaching a leading end of the flat cable to the lock base; simultaneously inserting the lock base and the leading end of the flat cable into the flat cable terminal insertion chamber; and positively locking the lock base to the connector housing.

According to the first aspect of the present invention, the lock member is fixed to the forward end of the flat cable. The flat cable is inserted together with the lock member into the cable insertion chamber of the connector housing so that the flat cable is connected to the terminals inserted into the terminal receptacles. Because the slipping-off prevention device engages with the connector housing when the lock member is inserted into the cable insertion chamber, the flat cable is kept in a state in which the flat cable is prevented from slipping off.

The connector housing and the lock member may be formed of different kinds of materials because, sometimes, the connector housing is connected to a printed wiring substrate, or the like, by reflowing soldering this situation, it is preferable to form the connector housing from a heat resistant material. In the selection of a material for the lock member, however, a heat resistant property is not required because the lock member for fixing the flat cable is formed separately from the connector housing.

According to the second aspect of the present invention, the terminals are integrated with each other through the connection portion in advance. Accordingly, the terminals are inserted collectively into the terminal receptacles, and after the insertion, the connection portion is cut off so that the terminals are separated from each other.

The effects of the present invention are as follows. According to the first aspect of the present invention, the connector housing and the lock member are provided separately from each other. Accordingly, the opening in the inlet portion of the cable insertion chamber can be opened fully. Further, the lock member, which has a high rigidity, is attached to the forward end of the flat cable so that the flat cable can be inserted together with the lock member into the cable insertion hole during the flat cable inserting operation. Accordingly, the inserting operation can be carried out easily and smoothly. Further, the flat cable is fixed to the lock member and mounted to the connector housing through the lock member. Accordingly, the retaining force against slipping-off of the flat cable is improved compared with the conventional type connector in which the flat cable is retained by being directly urged by the terminals. Further, a predetermined retaining force is obtained irrespective of the number of poles of the cable.

In addition, the connector housing and the lock member may be formed of different kinds of materials. Because the lock member and the connector housing are provided separately from each other, even though the connector housing requires a heat resistant material if it is desirable to solder the connector housing, the lock member does not require a heat resistant material. Accordingly, the degree of freedom in the selection of a material for the lock member is improved, so that reduction in cost is achieved.

Further, according to the second aspect of the present invention, the plurality of terminals can be inserted collectively into the terminal receptacles. Accordingly, the inserting work can be carried out efficiently.

These and other aspects and advantages of the present inventions are described in or apparent from the following detailed description of preferred embodiments.

BRIEF DESCRIPTION OF THE DRAWINGS

The preferred embodiments are described with reference to the drawings in which.

DETAILED DESCRIPTION OF PREFERRED EMBODIMENTS

An embodiment of the present invention is described below in detail with reference to FIGS. 1–5.

A housing 1 of a connector is molded as one body from a synthetic resin material. As the synthetic resin material for the housing 1, a heat resistant or flame retardant material is selected considering that the housing 1 is connected to a substrate by reflowing soldering. Preferred examples of the material include PPS resin, LCP resin, and so on.

Figure 2:
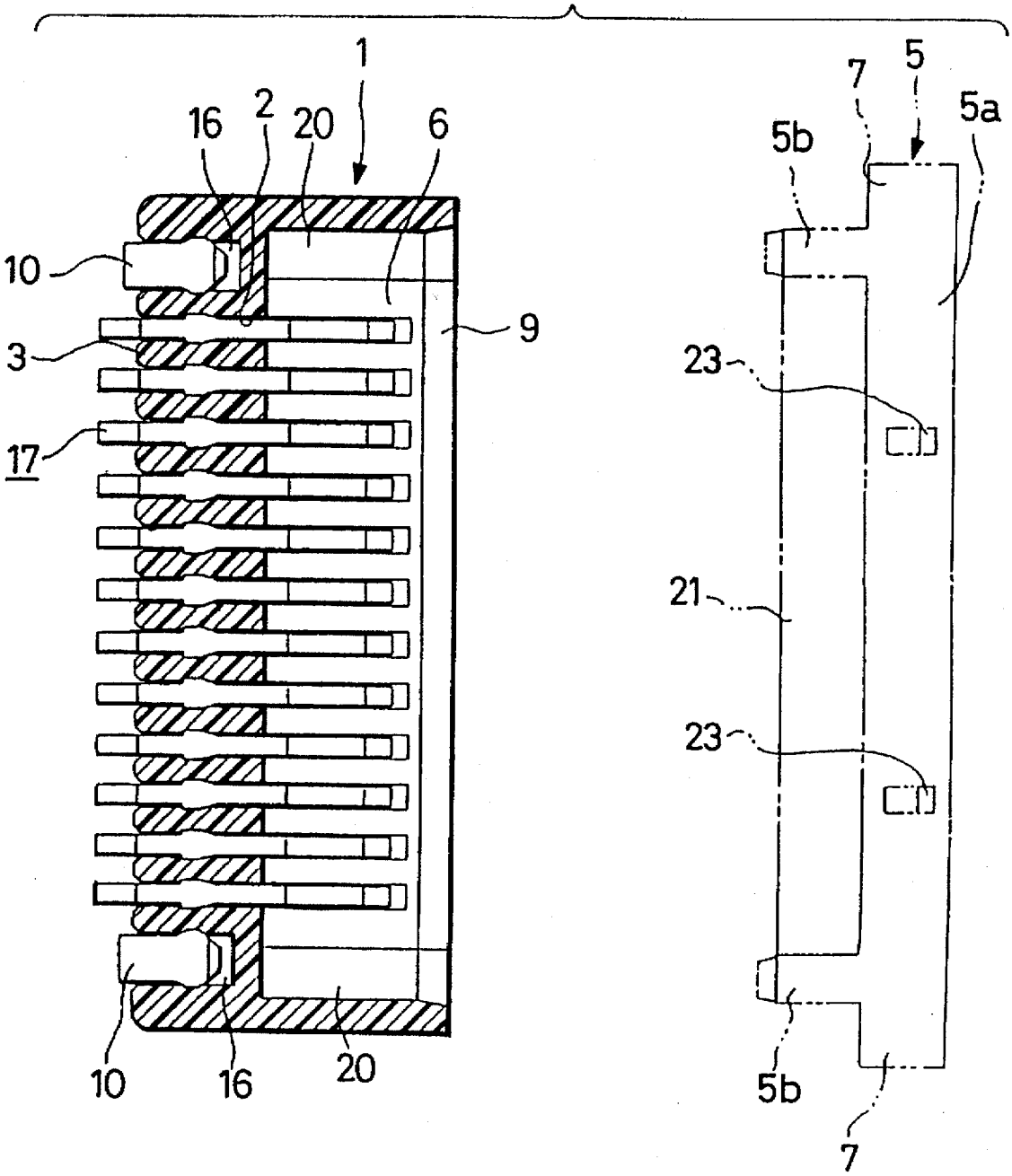
FIG. 2 is a plan cross-sectional view of the connector.
Figure 3:
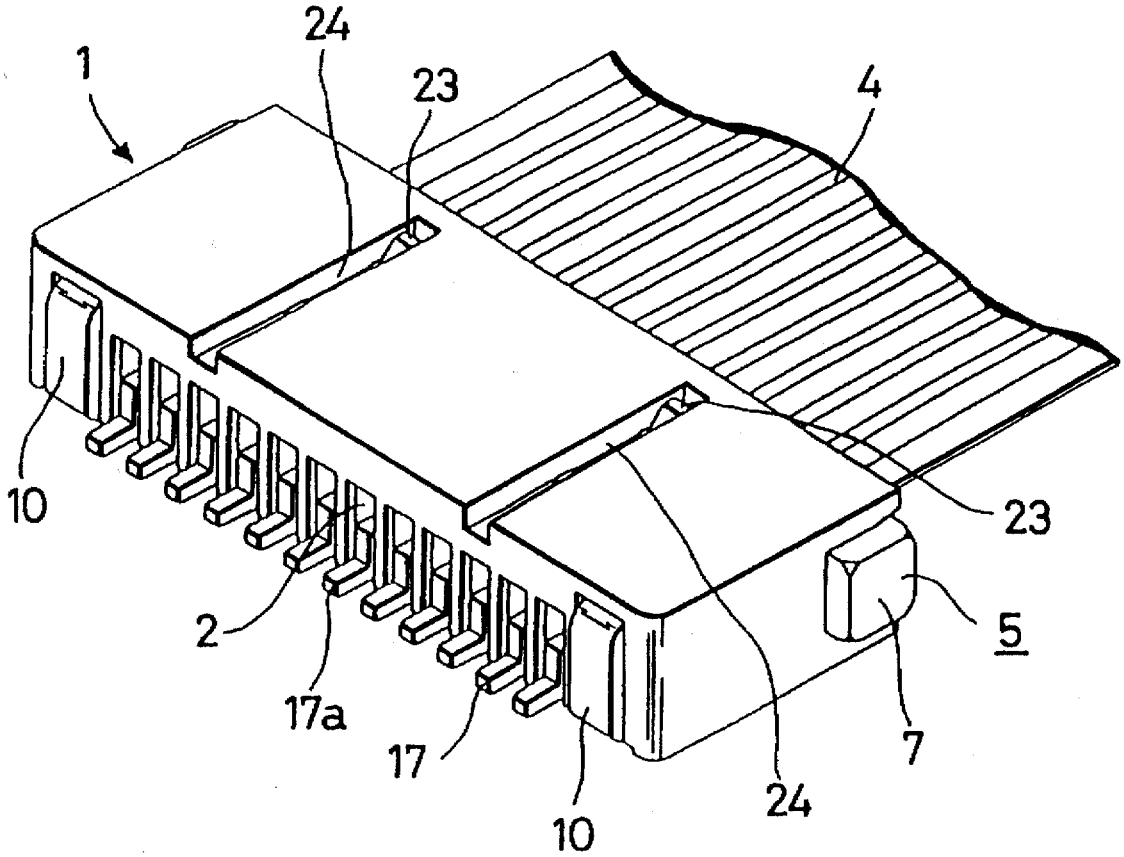
FIG. 3 is a perspective view showing the condition in which a flat cable is inserted.

In the inside of the housing 1, a large number of terminal receptacles 2 are arranged side by side in the direction of the width of the housing 1 so as to be opened in the front (left side in FIG. 2) of the housing 1. The respective terminal receptacles 2 are separated from each other in a comb-like structure using separators 3 that are formed to extend horizontally in FIG. 2 or perpendicularly to the widthwise or longitudinal direction of the housing 1. As shown in FIG. 2, each of the separators 3 is formed to have a horizontal depth between the front of the housing 1 and a predetermined position in the inside of the housing 1. That is, each of the separators 3 does not extend to the rear side of the housing 1 (left side in FIG. 2) from the predetermined position, so that a space is formed in the housing 1 so as to be communicated with all the terminal receptacles 2. This space forms a cable insertion chamber 6 into which a flat cable 4 and a lock member 5 (described later) are to be inserted.

Figure 1:
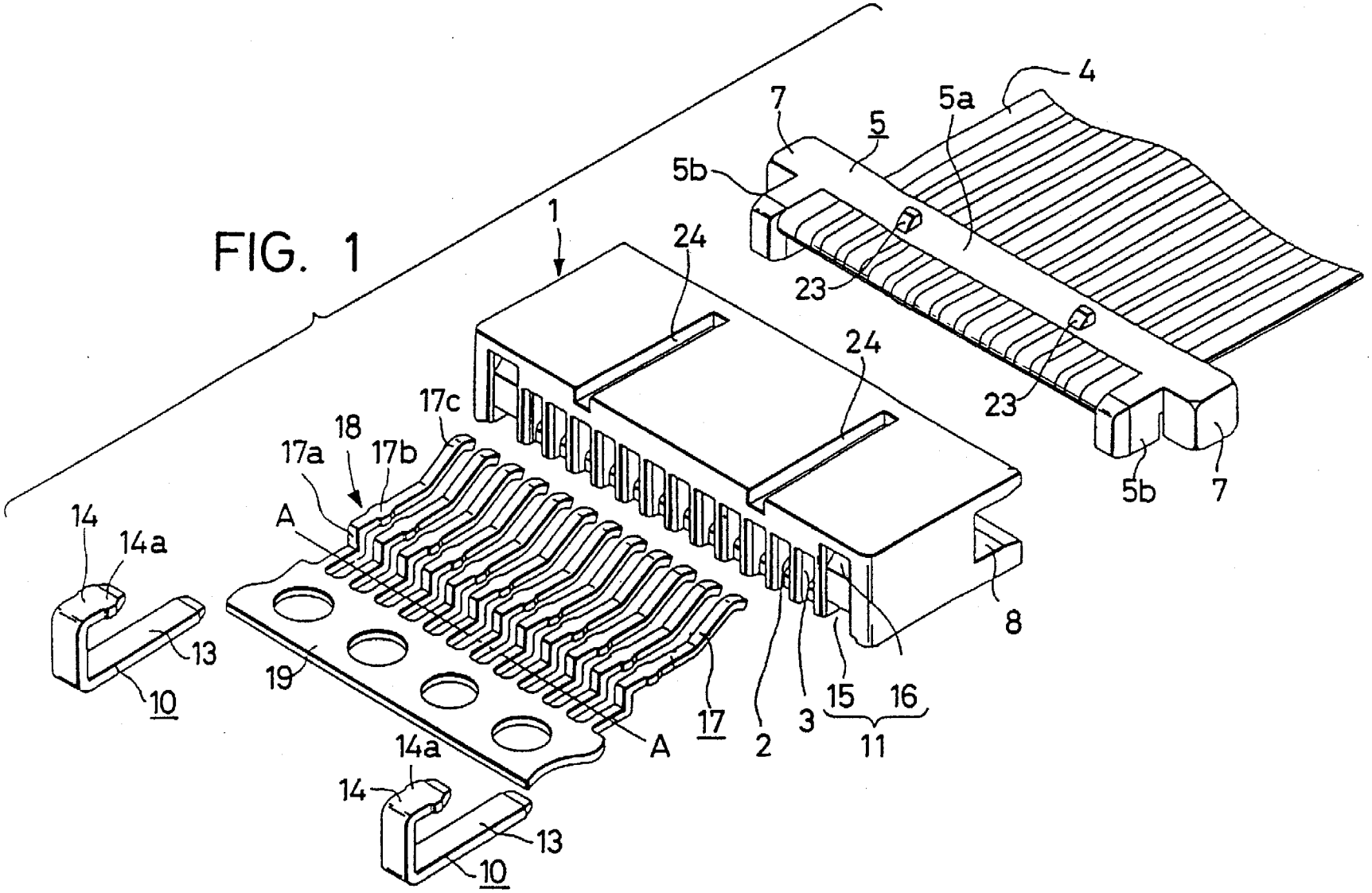
FIG. 1 is an exploded perspective view of a connector according to the present invention.

Further, as shown in FIG. 1, lock cavities 8 engageable with overhang portions 7 of the lock member 5 (described later) are formed respectively as notches in the widthwise or longitudinally opposite sides of the cable insertion chamber 6 of the housing 1. As shown in FIG. 2, two guide grooves 20 are arranged in the upper and lower sides or longitudinally opposite sides of the cable insertion chamber 6 so as to be capable of receiving two positioning projections **5*b* of the lock member 5. Further, a projecting edge 9 is provided at the opening of an inlet portion of the cable insertion chamber 6 so as to extend from the lower edge of the opening and so as to extend between the two guide grooves 20 along the width of the housing 1**.

Figure 4A:
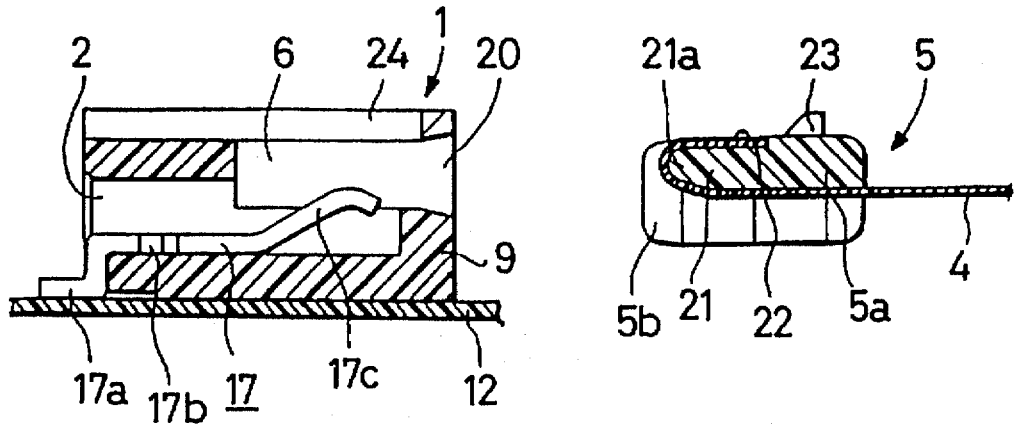
FIGS. 4A and 4B are side cross-sectional views showing the operation of inserting the flat cable.
Figure 4B:
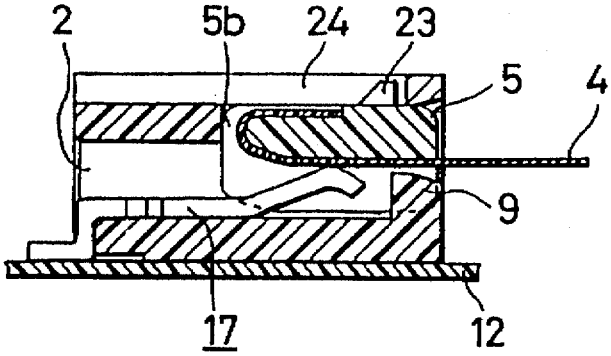

Two mount portions 11 for mounting two holders 10 are arranged in left and right positions in the widthwise or longitudinal direction in FIG. 1 in the front of the housing 1. The two holders 10 are provided to fix the housing 1 to a printed circuit substrate 12 (FIGS. 4A and 4B). Each of the two holders 10 is formed of a metal material, and is formed by bending the metal material into a U-shape so that the holder 10 has upper and lower parts that have different lengths. The lower part of the holder 10 forms a connection part 13 connected to the upper surface of the substrate 12 whereas the upper part of the holder forms an engagement part 14 engaged with the housing 1.

Figure 5:
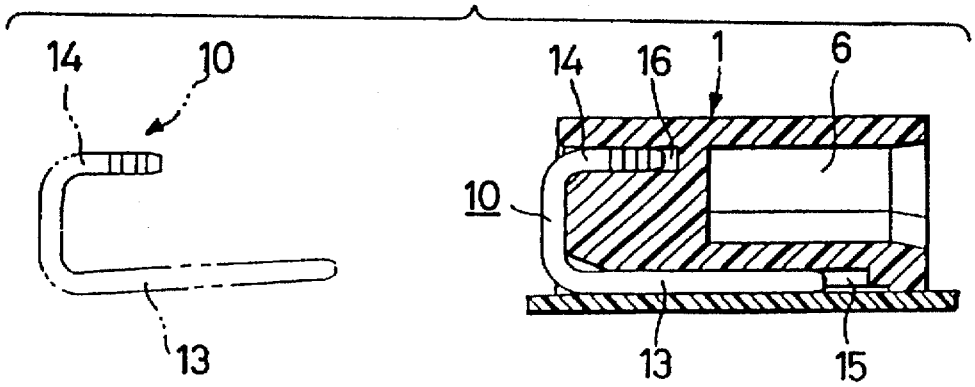
FIG. 5 is a side cross-sectional view showing the operation of inserting holders.
Figure 6:
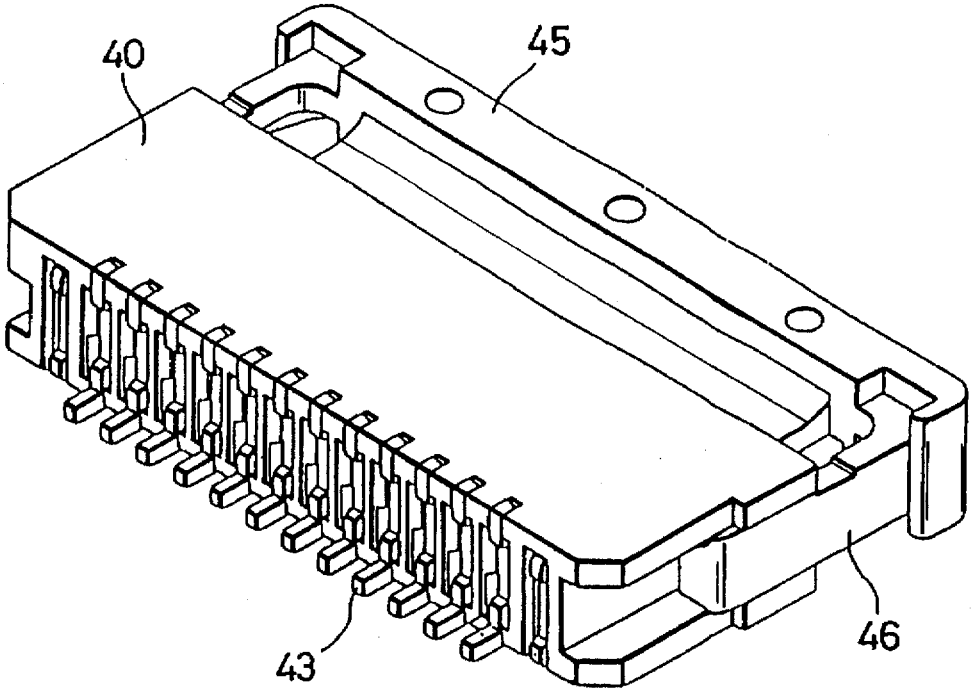
FIG. 6 PRIOR ART
FIG. 6 is a perspective view showing a conventional connector.
Figure 7A:
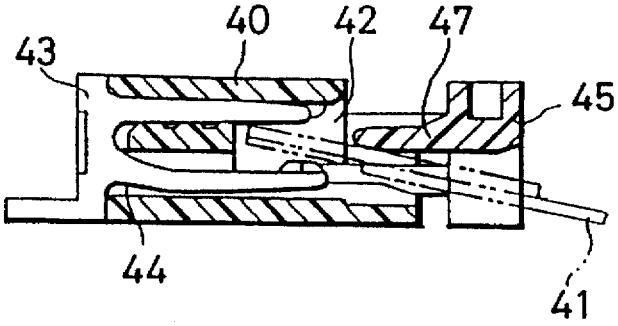
FIG. 7A PRIOR ART
FIGS. 7A and 7B are sectional views showing the sequence of inserting a flat cable into the conventional connector.
Figure 7B:
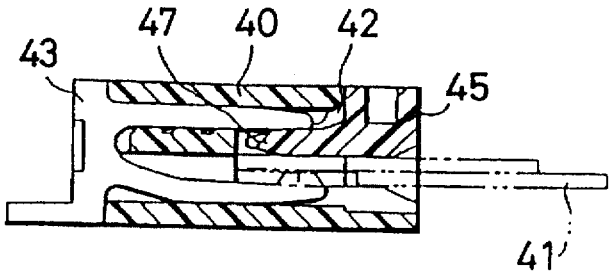
FIG. 7B PRIOR ART

As shown in FIG. 5, each of the two holders 10 is formed so that a free end portion of the connection part 13 thereof turns slightly obliquely upward. Further, a free end portion of the engagement part 14 of each holder 10 extends in left and right directions (FIG. 1) to form a forced insertion portion 14*a*. Each of the two mount portions 11 in the housing 1 includes a groove portion 15 indented in the lower surface of the housing 1 so as to be engageable with the connection part 13 of the corresponding holder 10. Each mount portion 11 also includes an insertion hole 16 formed above the groove portion 15 so as to be in parallel with the groove portion 15 and so as to be capable of receiving the engagement part 14. Not only is the forced insertion portion 14*a* brought into forced contact with the wall of the insertion hole 16 to prevent the holder 10 from slipping off, but the holder 10 is also corrected or reformed so that the engagement part 14 and the connection part 13 are substantially parallel with each other when the engagement part 14 is inserted into the insertion hole 16. The fixture of the housing 1 is strengthened by the clamping force created at the time of the insertion.

As shown in FIG. 1, terminals 17 are included in a terminal unit 18 formed of a material excellent in electrical conductivity before the terminals 17 are attached into the housing 1. The base side of the terminal unit 18 forms a connection portion 19. The terminals 17 are connected to the connection portion 19 so that the respective bases of the terminals 17 are connected to the connection portion 19. The respective terminals 17 are arranged at intervals of the same pitch as that of the terminal receptacles 2 so that they can be inserted into the corresponding terminal receptacles 2. As described above, the terminal unit 18 is initially in a state in which the terminals 17 are united into one body. After the respective terminals 17 are inserted into the terminal receptacles 2, the terminal unit 18 is cut along the line A—A in FIG. 1 so that the respective terminals 17 are individually separated from the connection portion 19. The separating operation is carried out by an automatic cutter not shown (or may be carried out manually by a human operator).

The terminals 17 will be described below more in detail. Each of the terminals 17 has a leg portion 17*a* provided in a position near the cutting point at which the terminals 17 are separated from the connection portion 19 so that the leg portion 17*a* comes into contact with the substrate 12. The leg portions 17*a* project to the outside of the terminal receptacles 2 when the terminals 17 are attached to the housing 1. In the front side of the leg portions 17*a*, the terminals 17 extend nearly vertically and also extend forward to form extension portions. The extension portions form stopper surfaces that are brought into contact with the lower edge portion in the inlet side of the terminal receptacles 2 to thereby limit the quantity of insertion of the terminals 17.

Further, in each of the terminals 17, a pair of slip-off prevention projections 17*b* are formed in a position near the extended portion and extend in the direction perpendicular to the longitudinal direction of the terminal 17. The distance between the opposite ends of the pair of slip-off prevention projections 17*b* is formed so as to be slightly larger than the width between side walls in each of the respective terminal receptacles 2, so that the terminals 17 are forcedly inserted into the terminal receptacles 2 so as to substantially prevent slipping-off. Further, the receptacle-side end portion of each of the terminals 17 is bent substantially into an L-shape to form a spring portion 17*c* that can be reformed flexibly so that the spring portion 17*c* can be brought into contact with the flat cable 4 by elastic force.

The flat cable 4 and lock member 5, which are to be inserted into the aforementioned cable insertion chamber 6, will be described below. The lock member 5 is formed in one body by molding from a synthetic resin material. For example, a material such as nylon, propylene, or the like, may be used as the synthetic resin material because the lock member 5 is different from the housing 1 in that the lock member 5 does not especially require heat resistant/flame retardant property.

The lock member 5 includes a lock base 5*a* as a main portion, and a pair of positioning projection parts 5*b* that are disposed in the front of the lock base 5*a* so as to be located in left and right positions (in FIG. 1) in the vicinity of the opposite ends of the lock base 5*a*. The pair of positioning projection parts 5*b* can be inserted into the guide grooves 20, respectively. That is, the pair of positioning projection parts 5*b* move forward while being guided by the guide grooves 20, so that the operation of inserting the lock member 5 is guided. Further, a cable fixing part 21 on which a forward portion of the flat cable 4 is wound is formed between the pair of positioning projection parts 5*b* to extend forward (left in FIG. 2) and horizontally. The cable fixing part 21 is laid laterally at a predetermined height between the positioning projection parts 5*b* so that an opening is formed under the cable fixing part 21. Accordingly, the cable fixing part 21 can be inserted into the cable insertion chamber 6 while interference between the cable fixing part 21 and the projecting edge 9 is avoided. After insertion, the flat cable 4 and the respective terminals 17 can come into contact with each other in the condition in which the terminals 17 are forcedly moved downward.

The flat cable 4 is wound on the cable fixing part 21 along the opposite surfaces of the cable fixing part 21 so as to be arranged from the lower surface of the cable fixing part 21 to the upper surface thereof and is fixed by an adhesive agent disposed between contact surfaces of the flat cable 4 and cable fixing part 21. In this case, a step portion 22 is formed on the upper surface of the cable fixing part 21 to provide a ledge that is slightly larger than the thickness of the flat cable 4. The ledge enables the top surface of the flat cable 4 to be located approximately level with the upper surfaces of the positioning projection parts 5*b* so that the flat cable 4 is less inclined to rub the upper opening edge of the cable insertion chamber 6 when the flat cable 4 is inserted together with the lock member 5. Further, the lower side of the end edge of the cable fixing part 21 is shaped into a gentle circular arc surface 21*a* so that the cable fixing part 21 can pass through smoothly without collision with the respective ends of the terminals when the flat cable 4 is inserted.

In the lock base 5*a*, the overhang portions 7 outside the two positioning projection parts 5*b* can engage with the lock cavities 8 of the housing 1 to thereby limit the depth of insertion of the flat cable 4 into the housing 1. Further, a pair of lock projections 23 are arranged to project separately from each other at a distance on the upper surface of the lock base 5*a* so that the lock projections 23 are engageable with a corresponding pair of lock grooves 24 formed in the upper surface of the housing 1 to thereby prevent the lock member 5 from slipping off. The lock projections 23 engage with the end positions (the rear side of the housing 1) of the lock grooves 24, respectively.

The operation and effect of this embodiment configured as described above will be described below. In this embodiment, the respective terminals 17 are inserted in the terminal receptacles 2 before the flat cable 4 is inserted. In this case, because the terminals 17 can be handled collectively in the form of a terminal unit 18 so that the terminals 17 in the form of the terminal unit 18 corresponding to all the poles of the cable can be inserted simultaneously into the respective terminal receptacles 2, the operation of attaching terminals can be performed smoothly and efficiently. Further, the terminal unit 18 is cut along line A—A shown in FIG. 1 after the insertion thereof so that the terminals 17 are cut off from and separated from each other.

In the case where the entire housing 1 is to be attached to the substrate 12, the two holders 10 are mounted to the mount portions 11. That is, the engagement parts 14 of the holders 10 are inserted into the insertion holes 16 so that the connection parts 13 are fitted to the groove portions 15. As described above, the holders 10 are mounted to the mount portions 11 by clamping force between the lock parts 14 and the connection parts 13. Not only is a positioning function fulfilled in the way of mounting, but also the forced insertion portions 14*a* bite into the walls of the insertion holes 16 to prevent the holders 10 from slipping off as a whole. After completion of the mounting of the two holders 10 as described above, the housing 1 is set on the substrate 12 and connected thereto by reflowing soldering. As described above, the housing 1 in the form of a single unit is mounted onto the substrate 12 in this embodiment. That is, in the conventional case, the slide member for fixing the flat cable 4 must be united with the connector in the temporary lock state of the flat cable 4; accordingly, the slide member may be accidentally moved to the formal lock position. In the conventional case, therefore, an additional operation for restoration of the slide member is required. In the present invention, the housing 1 can be used in the form of a single unit, so that the aforementioned extra assembly step is not required.

In the case of insertion of the flat cable 4, the flat cable 4 is inserted together with the lock member 5 into the connector because the flat cable 4 is integrated with the lock member 5 in advance. In this case, when the two positioning projection parts 5*b* are first fitted to the guide grooves 20 and pushed into the guide grooves 20, the lock member 5 receives a guiding operation caused by the engagement between the positioning projection parts 5*b* and the guide grooves 20 so that the lock member 5 is pushed into the housing 1 while being positioned. Further, the circular arc surface 21*a* at an end of the cable fixing part 21 slides on the terminals 17 while the respective forward ends of the terminals are reformed to be pushed down gradually while avoiding the collision between the circular arc surface 21*a* and the respective forward ends of the terminals 17. When the insertion of the lock member 5 is then made up to a position where the two overhang portions 7 engage with the corresponding lock cavities 8, the lock projections 23 engage with the end positions of the lock grooves 24, respectively. As a result, the lock member 5 is inserted together with the flat cable 4 into the housing 1 while the lock member 5 is prevented from slipping off. At the same time, the forward ends of the terminals 17 are brought into contact with the flat cable 4 so as to be electrically connected to the cable 4.

As described above, in this embodiment, the cable insertion chamber 6 is open widely so that the flat cable 4 can be inserted together with the lock member 5 into the housing 1. Accordingly, the insertion of the flat cable 4 into the housing 1 is performed smoothly. Further, because the retaining force of the flat cable 4 depends on the adhesive force between the flat cable 4 and the lock member 5, the influence by the number of poles of the cable in the terminals 17 as in the conventional case is avoided. Accordingly, prevention of slipping-off is achieved stably. Further, in this embodiment, the lock member 5 is formed of a low cost material, so that reduction in overall cost for production of the connector can be attained compared with the conventional case.

It is to be understood that the present invention is not limited to the aforementioned embodiment and that the following modifications of the invention may be considered to be included in the technical scope thereof. (1) The device for mounting the flat cable 4 and the lock member 5 to each other is not limited to using an adhesive agent described above. For example, other mounting techniques include ultrasonic welding, screwing, or the like. In short, any technique or structure may be used so long as the flat cable 4 can be directly or indirectly mounted to the lock member 5. (2) Although the lock grooves 24 have been shown to be formed in connection with molding, it may be practically sufficient that the lock grooves 24 are formed not by passing through, for example, long holes, but by boring holes only in necessary positions to be engaged with the lock projections 23. (3) With respect to the lock device of the lock member 5, lock projections 23 and grooves fitted to the lock projections 23 may be provided in the housing 1 and in the lock member 5, respectively, in the reverse order to this embodiment.

The invention has been described in detail with reference to preferred embodiments thereof, which are intended to illustrative, not limiting. Various modifications can be made without departing from the spirit and scope of the invention as defined in the appended claims.

What is claimed is:

1. A flat cable connector, comprising:

a cable insertion chamber formed in a rear portion of a chamber extending through a connector housing so that a forward end of a flat cable is insertable into said cable insertion chamber;

terminal receptacles formed in a front portion of said chamber so that each one of a plurality of terminals integrally connected together by a connection portion is insertable into a respective one of said terminal receptacles for attachment therein, each of said terminals projecting into said cable insertion chamber to be connectable with said flat cable, said connection portion removably connected to respective base portions of said terminals to be disassociated from said terminals when said terminals are attached to said connector housing to render individual ones of said terminals secured in a respective one of said terminal receptacles, each of said terminals having an anchor portion, a spring portion and a distal end portion, said anchor portion extending longitudinally in a respective one of said receptacles, said spring portion pivotally and flexibly connected to said anchor portion and extending from said anchor portion at an obtuse angle in a direction to project away from the front portion of said chamber and into said cable insertion chamber and said distal end portion extending rewardly of said spring portion to project away from the front portion of said chamber, said distal end portion forming a surface for contacting the forward end of the flat cable when inserted into said cable insertion chamber thereby causing said spring portion to pivot and flex; and a lock member fixed to said forward end of said flat cable whereby said flat cable passes around at least a portion of said lock member and a portion of said flat cable facing said terminals is exposed, said lock member being insertable into said cable insertion chamber and including at least one stationary lock projection element formed on and extending outwardly from an upper surface of said lock member and sized to be received by said cable insertion chamber and engageable with a groove formed in said connector housing so that said lock member can be retained within said cable insertion chamber.

2. The connector of claim 1, wherein the terminals are commonly mounted on a connection portion that is detachable after the terminals have been inserted into said terminal insertion chambers.

3. The connector of claim 1, wherein each of said terminals includes a leg portion adapted to be connected to a substrate onto which the housing is mounted, each of said terminals also including a step portion connected to said leg portion, said step portions being adapted to limit the amount of insertion of said terminals into respective ones of said terminal receiving chambers.

4. The connector of claim 3, wherein each of the terminals further comprises a slip-off prevention device for engaging side walls of said terminal insertion chambers to fix the terminals in place.

5. The connector of claim 1, wherein said connector housing includes mount portions that are each adapted to receive a U-shaped holder.

6. The connector of claim 5, wherein each of said mount portions includes a groove portion and an insertion hole that is approximately parallel to said groove portion, and wherein said U-shaped holder includes a connection part that is insertable into said groove portion and an engagement part that is insertable into said insertion hole, said engagement part including a device for positively engaging side walls of said insertion hole.

7. The connector of claim 1, wherein the connector housing and the lock member are made of different materials.

8. A flat cable connector according to claim 1, wherein the upper surface of said lock member defines a ledge on said lock member sized to receive an end portion of said flat cable in a manner whereby the end portion of the exposed cable tends to avoid contact with said connector housing when said lock member is inserted into and retained within said cable insertion chamber.

9. A flat cable connector according to claim 8, wherein the leading edge surface of said lock member has a curved cross-sectional configuration.

10. A flat cable connector according to claim 9, wherein said flat cable and said lock member are affixed to each other by an adhesive material.

* * * * *